US005298745A

United States Patent [19]

Kernan et al.

[11] Patent Number: 5,298,745

[45] Date of Patent: Mar. 29, 1994

[54] MULTILAYER MULTIPOLE

[75] Inventors: Jeffrey T. Kernan, Mountain View; Donald A. Johnson, Portola Valley; Charles W. Russ, IV, Sunnyvale, all of Calif.

[73] Assignee: Hewlett-Packard Company, Palo Alto, Calif.

[21] Appl. No.: 984,610

[22] Filed: Dec. 2, 1992

[51] Int. Cl.[5] ..... H01J 49/42

[52] U.S. Cl. ..... 250/292; 250/293

[58] Field of Search ..... 250/292, 291, 293; 313/256

[56] References Cited

U.S. PATENT DOCUMENTS

| | | | |
|---|---|---|---|
| 3,328,146 | 6/1967 | Hanlein | 65/60 |
| 3,457,404 | 7/1969 | Uthe | 250/292 |
| 3,699,330 | 10/1972 | McGinnis | 250/292 |
| 3,819,941 | 6/1974 | Carrico | 250/292 |
| 4,230,943 | 10/1980 | Franzen et al. | 250/281 |
| 4,885,500 | 12/1989 | Hansen et al. | 313/256 |

*Primary Examiner*—Paul M. Dzierzynski
*Assistant Examiner*—Kiet T. Nguyen

[57] ABSTRACT

Multipole technology is used generally for charged particle optics which includes separating, focusing, or collimating "charged particles" (i.e., ions, electrons, etc.). A primary application of multipole technology is mass filters and particularly quadrupole mass filters. A quadrupole mass filter has a quadrupole substrate having four poles, each having a generally hyperbolic cross section, and interconnected by bridges. The bridges have apertures that facilitate the construction of poles inside the quadrupole substrate and prevent the build-up of unwanted charge. A plating substrate for electroplating is bonded to each pole substrate with a thin-film adhesion layer. Poles are electroplated upon these plating substrates. A diffusion barrier layer prevents the portions of the plating substrates from migrating to the quadrupole substrate where they would undermine the thin-film adhesion layer. Additionally, the diffusion barrier layer prevents portions of the thin-film adhesion layer from migrating away from the quadrupole substrate that could result in adhesion problems and contamination of the poles. Quadrupole mass filters formed with metallization and electroplating techniques have the advantages of consistent and predictable performance, high durability, nearly uniform thickness, and nearly hyperbolic cross-section that results in electric fields with a nearly idealized hyperbolic cross section.

25 Claims, 8 Drawing Sheets

MULTILAYER MULTIPOLE

FIELD OF THE INVENTION

The invention relates generally to the field of charged particle optics and particularly to the field of quadrupoles mass filters.

BACKGROUND OF THE INVENTION

Multipole technology is used generally for charged particle optics which includes separating, focusing, or collimating "charged particles" (i.e., ions, electrons, etc.). A primary application of multipole technology is quadrupole mass filters. Mass filters are tools for analyzing the chemical composition of matter by using electric fields to separate charged particles. Quadrupole mass filters have four parallel elongated poles (i.e., electrodes) and opposing parallel poles are electrically connected. The poles have a cross-section that closely approximates hyperbolic arcs in respective quadrants about a common origin.

A radio-frequency power amplifier (RFPA) drives both pairs of poles. A selected radio frequency (RF) signal summed with a positive direct current (DC) potential drives one set of poles. An RF signal, 180° out of phase with that applied to the first pair, summed with a negative DC potential drives the other pair of poles.

The RF field dominates the motion of relatively light charged particles, ejecting them from the functional center region of the quadrupole filter. The DC field dominates the relatively heavy charged particles and causes poles to attract and adsorb charged particles of opposite conductivity. Charged particles of an appropriate intermediate weight can traverse a generally longitudinal trajectory through the center of the quadrupole due to offsetting RF and DC effects.

By properly setting the RF and DC components of the mass selection field inside the quadrupole, the quadrupole can select for detection and measurement any mass within the operating range of the unit. Alternatively, a quadrupole can function as a high pass filter. The DC component equals zero and RF amplitude determines the low mass transmission limit.

The theoretically ideal cross section for the four poles of a quadrupole mass filter is four hyperbolic curves extending in their respective quadrants to infinity. Generally, the quadrupole mass filter approximates only the portion of the hyperbolic arcs near their origins. They approximate the arcs with solid metal rods (e.g., molybdenum or stainless steel) that have been ground to a desired shape. The quadrupole mass filters maintain the desired relative arrangement of the four ground rods by a harness of ceramic or other rigid, non-conductive material.

However, there are several disadvantages to this four rod implementation of a quadrupole filter: expense, weight, bulk, and vulnerability to misalignment. For example, grinding identical hyperbolic surfaces on four several-inch long molybdenum rods is costly both in terms of time and materials. Furthermore, only the hyperbolic surface is electrically useful. The bulk of the rod serves only limited functions such as providing rigidity. If an internal or external force jolts the four rods in the ceramic harnesses, misalignment can easily occur. Furthermore, this misalignment may be undetectable by an unaided eye, and yet adversely affect the quality of performance.

U.S. Pat. No. 3,328,146 *Method of Producing An Analyzer Electrode System For Mass Spectrometers*, issued to Hänlein and assigned to *Siemens-Schuckertwere Aktiengesellschaft* and U.S. Pat. No. 4,885,500 *Quartz Quadrupole For Mass Filter*, issued to Hansen et al. and assigned to Hewlett-Packard Company describe quadrupole mass filters made from a glass quadrupole tube and thin strips of metal. The glass quadrupole tube has a cross-section of four interconnected truncated hyperbolas, semicircles, etc. that provide a substrate for the four poles of the quadrupole. Thin strips of metal conform to these four pole substrates and create four poles with a hyperbolic cross-section that produces an electric field with a hyperbolic shape.

Glass quadrupole mass filters have the advantage of eliminating the primary problems of the four rod quadrupple mass filters: weight, bulk, cost of manufacture, and vulnerability to misalignment. Glass quadrupole mass filters have the advantage of greatly reduced weight and bulk due to the substitution of glass and thin strips of metal for the refractory metal rods. Glass greatly reduces manufacturing costs since it is inexpensive and easily transforms into the desired quadrupole shape of a mandrel. This reduces the costs and time involved in grinding refractory metal rods from four rods per mass filter to one mandrel that forms many mass filters. Additionally, glass usually is less susceptible to small inelastic deformations than refractory metals, so glass quadrupoles produce valid measurements unless the glass breaks.

Quadrupole mass filters separate charged particles whose mass/charge ratio differs by approximately 1 AMU. To accomplish this, the poles must produce precisely-shaped hyperbolic electric fields. Additionally, electric fields produced by two adjacent poles should be out of phase by 180°, but otherwise have an identical shape and magnitude. If the poles fail to produce electric fields meeting these specifications, the quadrupole output may be less than optimal and the quadrupole may have impaired resolution. To produce electric fields that meet the specifications listed above, the poles must be thick enough that the resistance down the length of the poles is very low and the poles must precisely conform to the glass substrate of the quadrupole so that they have a hyperbolic cross-section.

U.S. Pat. No. 3,328,146 discloses forming a single metal metallized or mirrored surface on the hyperbolic glass surfaces by vaporizing or cathode sputtering gold on them. These gold poles may have several problems; poor adhesion, relatively high resistance resulting from a thin coating of gold, nonuniform thickness, and they may be difficult to make consistently in a manufacturing environment. Poor adhesion partially results from the weak bonds that pure gold forms with glass. Gold oxides can be created which would form strong bonds but it would convert back to pure gold at the high temperatures typical of an operational quadrupole mass filter. This pure gold would peel off the quadrupole. A relatively high resistance would produce a voltage drop down the approximately four to twelve inch length of the pole and would impair the ability of the mass filter to separate charged particles. Another problem with the sputtered gold pole would be the nonuniform thickness of the pole that would distort the shape of the electric field and impair the ability of the quadrupole mass filter to separate charged particles.

U.S. Pat. No. 4,885,500 teaches creating poles by positioning thin strips of silver having an adhesive backing ("silver tape") to the hyperbolic contours of the inner surface of the glass substrate. The silver tape must conform uniformly to the hyperbolic contours of the glass substrate to produce poles with a hyperbolic cross section and to produce electric fields with the desired hyperbolic shape. The primary disadvantages of previously-existing glass quadrupole mass filters include contamination of the silver tape by subsequent processing and the difficulty of manufacturing them in a highly controlled manner.

SUMMARY OF THE INVENTION

For the reasons previously discussed, it would be advantageous to have a multipole mass filter having high durability, high performance, and high manufacturing yields.

The present invention is a multilayer multipole having an insulating multipole substrate with apertures, thin-film plating substrates that conform to the convoluted interior of the multipole substrate, and precision-formed poles electroplated (or electroless plated) onto the plating substrates. Also, the present invention includes a thin-film adhesion layer that bonds the plating substrates to the convoluted interior of the multipole substrate. This adhesion layer may also function as a diffusion barrier or the multipole may have a separate diffusion barrier layer.

The multipole substrate has an even number of separate sections for the poles, each having an inner surface with a generally hyperbolic cross section. The poles are interconnected by bridges that have apertures. There can be several apertures in each bridge or one elongated aperture per bridge. The apertures have the advantage of facilitating the construction of the plating substrates, the adhesion layer, and the diffusion barrier layer on the convoluted interior of the multipole substrate. Additionally, these apertures eliminate large sections of the pole/bridge interface where electrical charge builds-up and distorts the mass selection electric fields produced by the poles and interferes with charge particle separation. These apertures have the additional advantage of facilitating vacuum conductance.

The adhesion layer is a thin-film layer that forms strong bonds with the multipole substrate. Also, the adhesion layer may perform the function of a diffusion barrier. The thin-film plating substrates, sputtered onto the adhesion layer, or directly onto the multipole substrate forms an oxide-free surface for electroplating. Poles are electroplated onto the plating substrates to a desired thickness. An additional layer, a thin-film diffusion barrier layer may be deposited on the adhesion layer to prevent the diffusion of the substrate and the various layers.

This configuration has the advantage of producing durable, high-performance poles with high manufacturing yields. The thin-film adhesion layer durably bonds the poles to the insulating substrate. The thinness of the adhesion layer and the plating substrate layer allows them to conform precisely to the inner surfaces of the multipole substrate so that they provide the poles with a plating surface that duplicates the hyperbolic shape of the inner surfaces of the multipole substrate. Electroplating processes form poles with low resistance, uniform thickness, and a nearly ideal hyperbolic cross-section so that high performance multipoles have consistent and predictable performance and achieve high manufacturing yields.

The multipole substrate can have extended bridges that move the pole/bridge interfaces and the charges that accumulate there away from the center axis of the multipole. This has the advantage of substantially reducing the distortion of the mass selection electric fields because the strength of distorting electric fields produced by the accumulated charge at the pole/bridge interface decreases with the ratio of one over the square of the distance from the pole/bridge interface.

A multipole according to the present invention has the advantages of consistent and predictable performance, high durability, high performance, and high manufacturing yields. The durable poles create mass selection electric fields with a nearly idealized hyperbolic cross-section because the poles have low resistance, uniform thickness, conformity to the hyperbolic shape of the elongated substrate sections. The apertures prevent the build-up of electrical charge that distorts the mass selection fields produced by the poles. The extended bridges remove the pole/bridge interface from the center of the multipole where the charged particle separation, focusing, or collimating takes place. All of this is achieved with precision automated manufacturing techniques that result in high manufacturing yields.

DETAILED DESCRIPTION OF THE INVENTION

A person skilled in the art will readily appreciate the advantages and features of the disclosed invention after reading the following detailed description in conjunction with the drawings.

The preferred embodiment of the multilayer multipole is a quadrupole mass filter that separates charged particles in a charged particle beam according to their mass/charge ratio. Alternate embodiments of the invention can have six, eight, or more poles and can focus or collimate a charged particle beam instead of separating the charged particles. These alternate embodiments are manufactured in essentially the same way as the quadrupole mass filter.

Figure 1:
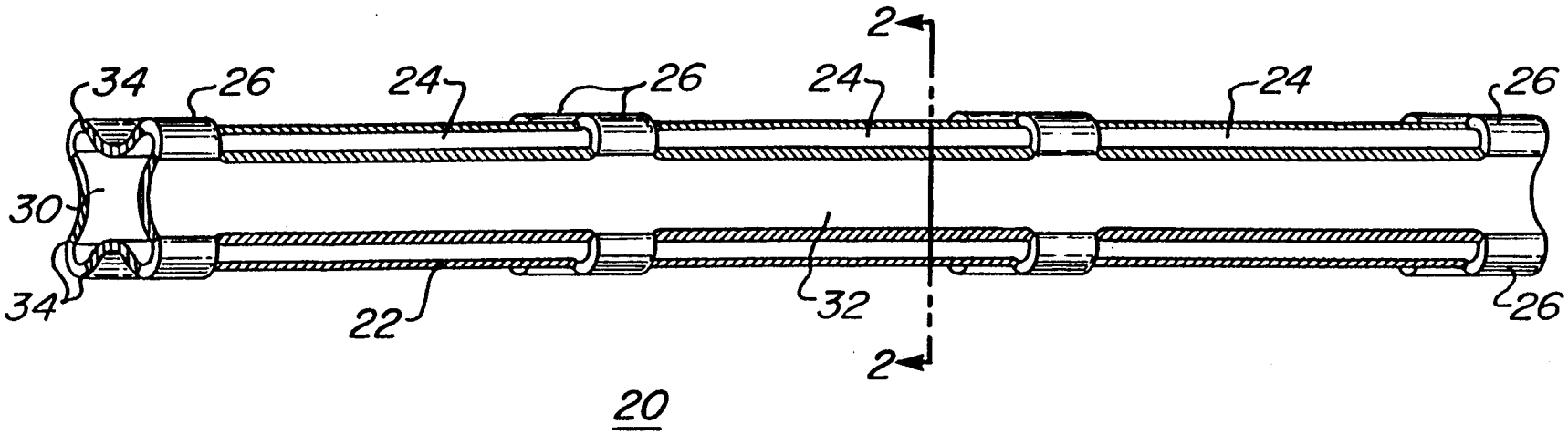
FIG. 1 shows the preferred embodiment of the multilayer quadrupole mass filter.
Figure 2:
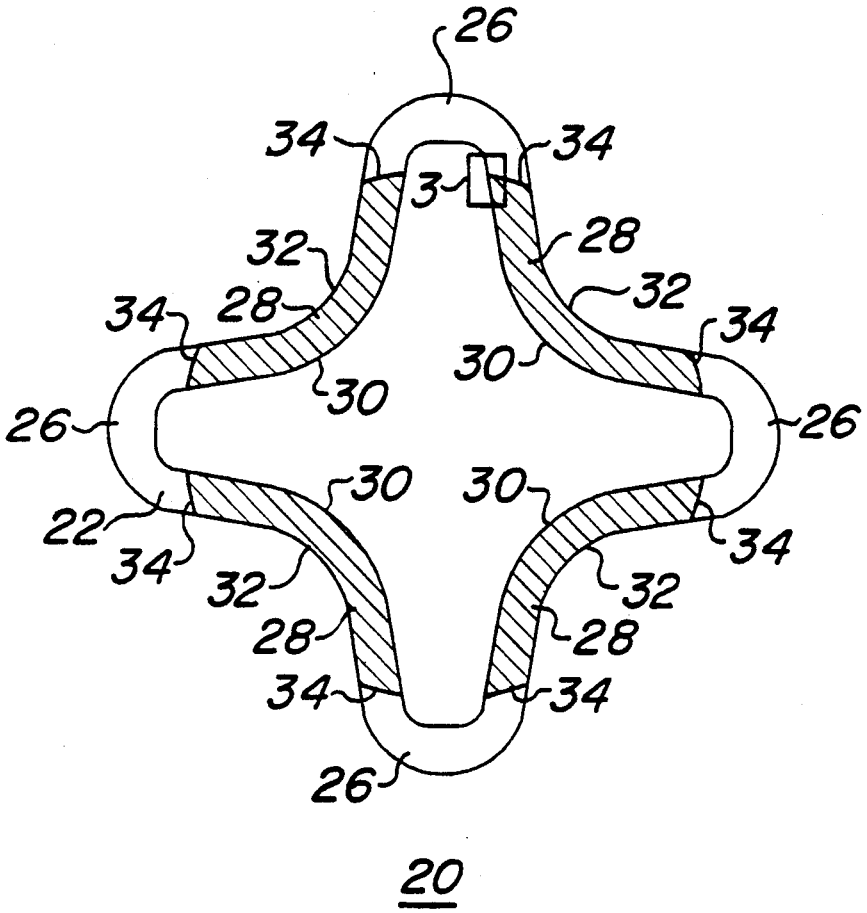
FIG. 2 shows a cross-section of the preferred embodiment of the multilayer quadrupole mass filter taken along the line 2—2 in FIG. 1.
Figure 3:
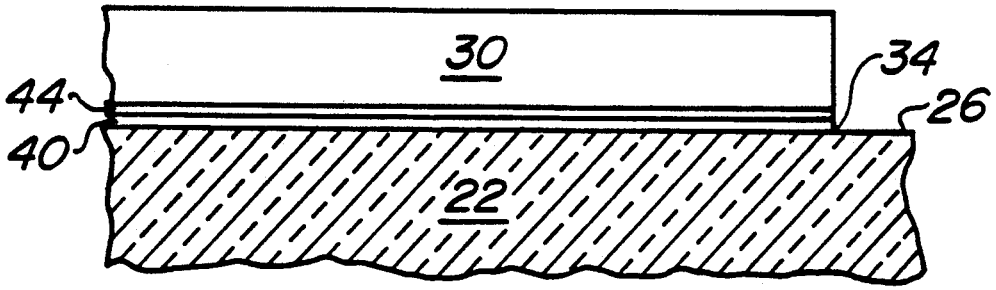
FIG. 3 shows details of the multilayer structure enclosed by a rectangle 3 in FIG. 2 for the preferred embodiment of the invention.
Figure 4:
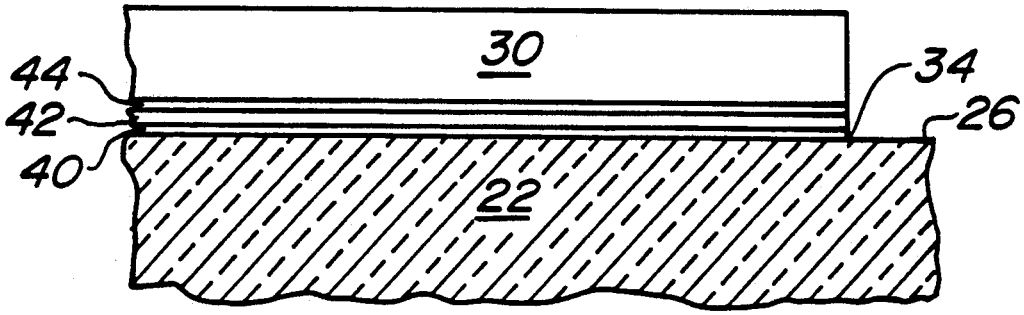
FIG. 4 shows details of the multilayer structure enclosed by rectangle 3 in FIG. 2 for an alternate embodiment of the invention.
Figure 5:
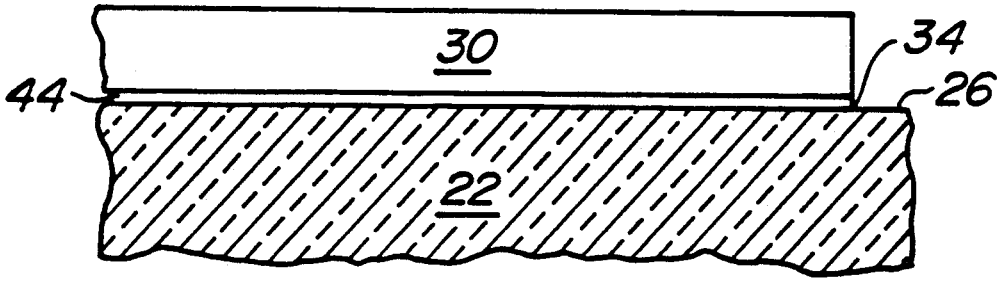
FIG. 5 shows details of the multilayer structure enclosed by rectangle 3 in FIG. 2 for an alternate embodiment of the invention.

FIG. 1 shows an isometric view of the preferred embodiment of a multilayer quadrupole mass filter 20. FIG. 2 shows a cross-section of multilayer quadrupole mass filter 20 taken along line 2—2 of FIG. 1. FIGS. 3, 4, and 5 show a magnified portion of the multilayer structure, a bridge 26, a pole 30, and a pole/bridge interface 34 for various embodiments of the invention.

The preferred embodiment of the multilayer quadrupole mass filter 20 has a glass quadrupole substrate 22. However, quadrupole substrate 22 could be formed from other materials without departing from the scope of the invention. The primary requirement of a material for a quadrupole substrate 22 is that it be electrically insulating.

The loss factor is the product of the insulating constant and the power factor (tangent of loss angle) for a material. The dielectric constant determines the amount of energy irrecoverably lost, as heat, due to the motion of dipoles in a RF field. Generally, as the temperature of the substrate increases, it loses a higher percentage of its energy to heat. Quadrupole mass filters typically operate at frequencies between 800 kHz and 4 MHz.

The significance of the loss factor in the context of the mass filter relates to thermal runaway in the substrate. Thermal runaway occurs when the amount of heat generated within the material exceeds the heat that can be radiated from the glass. The resulting increased glass temperatures lowers the volume resistivity of the glass and increases the loss factor, requiring the RFPA to generate more power, which causes even greater heat generation. This positive feedback cycle characterizes thermal runaway, which ultimately requires more power than can be supplied. The risk of thermal runaway increases at high mass settings that require higher RF voltages. Thus, high performance mass filters require substrates with low loss factors.

Volume resistivity is a measure of the insulating quality of a glass. Volume resistivity largely governs the risk of dielectric failure at elevated temperatures. In other words, a glass of high volume resistivity is less likely to suffer a dielectric breakdown and unacceptably load the RFPA. Volume resistivity is specified herein in units of $\log_{10}$ of volume resistivity in ohm-cm. A volume resistivity of about 10° at 250° C. is appropriate for high performance applications.

Thermal stress resistance refers to capability of a glass to resist damage during heating and cooling. The values used herein refer to the maximum temperature to which a plate sample can be heated and then plunged into water at 10° C. without breaking. While this scenario is not closely replicated within the environment of a mass filter, thermal stress resistance correlates sufficiently with other thermal variables of interest such as strain point, annealing point, softening point and working point, to serve as a general indicator of endurance under temperature-varying conditions. Generally, thermal stress resistance correlates with the hardness or viscosity of a glass.

The thermal coefficient of expansion is a measure of the degree to which a material expands when heated. If the coefficient is negative, the material contracts when heated. This parameter affects substrate formability since the substrate must conform at elevated temperatures to a mandrel that changes dimensions in the process. This parameter is important since dimensional changes impair mass axis stability, filter resolution, and transmission. A higher expansion coefficient also means that a quadrupole that changes in temperature will experience a change in diameter and consequently a mass assignment shift. For greatest simplicity and reliability in both formation and operation, the thermal coefficient of expansion should be positive and as close to zero as possible.

Returning to FIG. 1, the preferred embodiment of the multilayer quadrupole mass filter 20 is approximately 4 to 12 inches long. It has four poles 30 located on the convoluted interior surface of quadrupole substrate 22. Bridges 26 interconnect the four poles 30 and provide quadrupole substrate 22 with structural rigidity. Bridges 26 have apertures 24 that facilitate the formation of poles 30 and prevent the accumulation of electrical charge at the pole/bridge interface 34. The preferred embodiment of quadrupole substrate 22 shown in FIG. 1 is approximately 1.5 mm thick, has three apertures 24 per bridge that are approximately 50 mm long, and four bridges 26 per adjacent pole 30 pairs.

Electrical charge accumulates at the interface of the conductive poles 30 and the insulating bridges 26. This accumulated electrical charge creates electric fields that distort the mass selection fields created by the poles 30. This interference is particularly troublesome when selecting a high voltage setting before a low voltage setting as when going from a high mass setting to a low mass setting. The charge accumulation is greatest at high mass settings since the fields are strongest at these settings. When the mass setting switches from a high mass setting to a low mass setting, the charge accumulation begins to dissipate but during this dissipation it generates electric fields that distort the mass selection fields produced by the poles and that inhibit the passage of charged particles. Electric charge accumulates at a conductor/insulator interface. Removing sections of insulating bridge 26 from quadrupole substrate 22 creates apertures 24 and eliminates the corresponding conductor/insulator where electric charge accumulates and the destructive electric fields they generate.

Figure 8A:
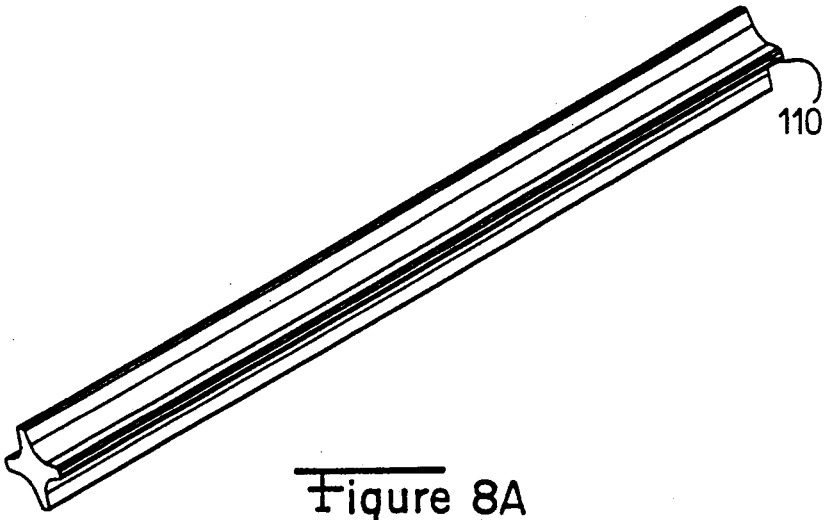
FIGS. 8A–8D show the steps in making the quadrupole substrate.

Quadrupole substrate 22 is made by conforming a hot glass tube to a mandrel 110 shown in FIG. 8A. Mandrel 110 should be made from a refractory metal or an alloy or composite of a refractory metal, such as molybdenum, tungsten, or an alloy of hafnium, carbon and molybdenum so that it can retain its shape after repeated exposures to the elevated temperatures used to form glass quadrupole substrate 22. Mandrel 110 must be machined, ground, and polished with the required precision so that its external dimensions correspond to the desired internal dimensions of the quadrupole substrate 22 at formation temperatures. Since the metals have greater thermal coefficients of expansion than glass, mandrel 110 must be slightly smaller than the desired interior of quadrupole substrate 22 at room temperature.

Figure 8B:
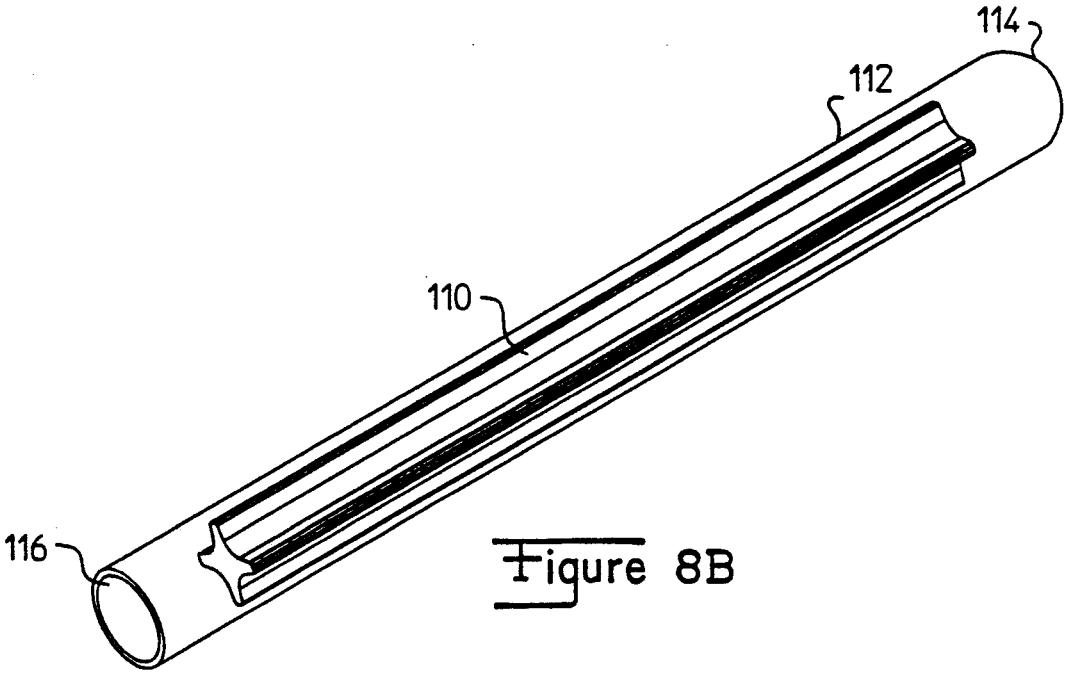
Figure 8C:
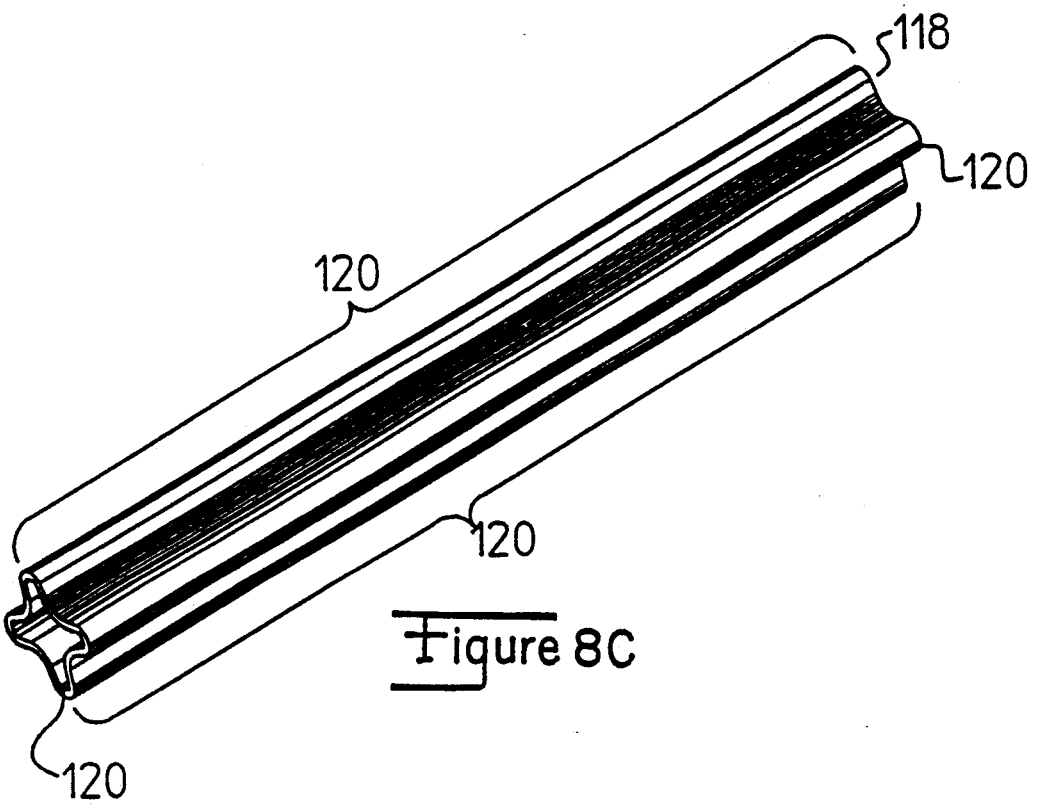

A glass tube 112 shown in FIG. 8B of circular cross section and appropriate diameter and thickness, is closed at one end 114. Mandrel 110 is inserted axially into glass tube 112 and an open end 116 of the glass tube is connected to a vacuum pump. Atmospheric pressure pushes a heated glass tube 112 tightly onto mandrel 110. Once the vacuum-formed glass tube 118 conforms to mandrel 110, it and the mandrel cool. During this phase, mandrel 110 contracts away from the vacuum-formed glass tube 118 so that glass tube 118, shown in FIG. 8C, can be easily removed.

Once vacuumed-formed glass tube 118 is removed, it is cut to the desired length, 4"-12" for the preferred embodiment. Sections of bridges 120, shown in FIG. 1, are ground or milled away to create aperatures 122.

FIGS. 3, 4, and 5 show details of the structure enclosed by rectangle 3 in FIG. 2 for various embodiments of the invention. FIG. 3 shows details for the preferred embodiment of the invention and FIGS. 4 and 5 show details for alternate embodiments of the invention.

FIG. 3 shows a thin-film adhesion/diffusion barrier layer 40 that forms strong bonds with quadrupole substrate 22, thin-film layer plating substrate 44, and electroplated pole 30. In the preferred embodiment of the invention, quadrupole substrate 22 is glass. Other materials could be used, but glass is preferred for the reasons previously described.

The preferred embodiment has plating substrates 44 made from gold but other metals could be used without departing from the scope of the invention. Noble metals are preferred because they do not develop an oxide film in an air environment, they are relatively inert, and they have a low resistivity. A plating substrate with an oxide free surface is desired because electroplated metals do not form strong bonds with metal oxides. Noble metal plating substrates 44 simplify the scheduling of manufacturing procedures because they are relatively inert and can be stored until needed. Forming plating substrates from a low resistivity noble metal allows them to be thin and have a low resistance. As previously discussed, resistance is directly proportional to resistivity and inversely proportional to the cross-sectional area. Thin plating substrates 44 have the advantage of greater durability because there is lower stress within the layer and better adhesion. An additional advantage of thin plating substrates 44 is their ability to conform precisely to the hyperbolic pole substrates, shown in FIG. 2, and provide a nearly ideal hyperbolic surface for electroplating.

Gold and other noble metals do not form strong bonds with glass. The preferred embodiment of the invention solves this problem by sputter depositing a thin-film adhesion/diffusion barrier layer 40 onto glass quadrupole substrate 22. Titanium and chromium form strong bonds with glass, but they can diffuse at temperatures over 150° C. Diffusion of the adhesion layer away from the substrate could cause adhesion problems, could interfere with the electroplating process, and could potentially change the surface conductivity of the post-plated poles 30. Tungsten has excellent diffusion characteristics but the tungsten/silicon dioxide bonds are weaker than either the titanium/silicon dioxide bonds or the chromium/silicon dioxide bonds. The preferred embodiment of the invention takes advantage of the diffusion characteristics of tungsten and the strong bonds titanium forms with silicon dioxide by sputter depositing onto inner surfaces of quadrupole substrates 22 a thin-film titanium/tungsten layer that is a composite of 10%-15% titanium and 85%-90% tungsten onto inner surfaces of quadrupole substrate 22.

Figure 8D:
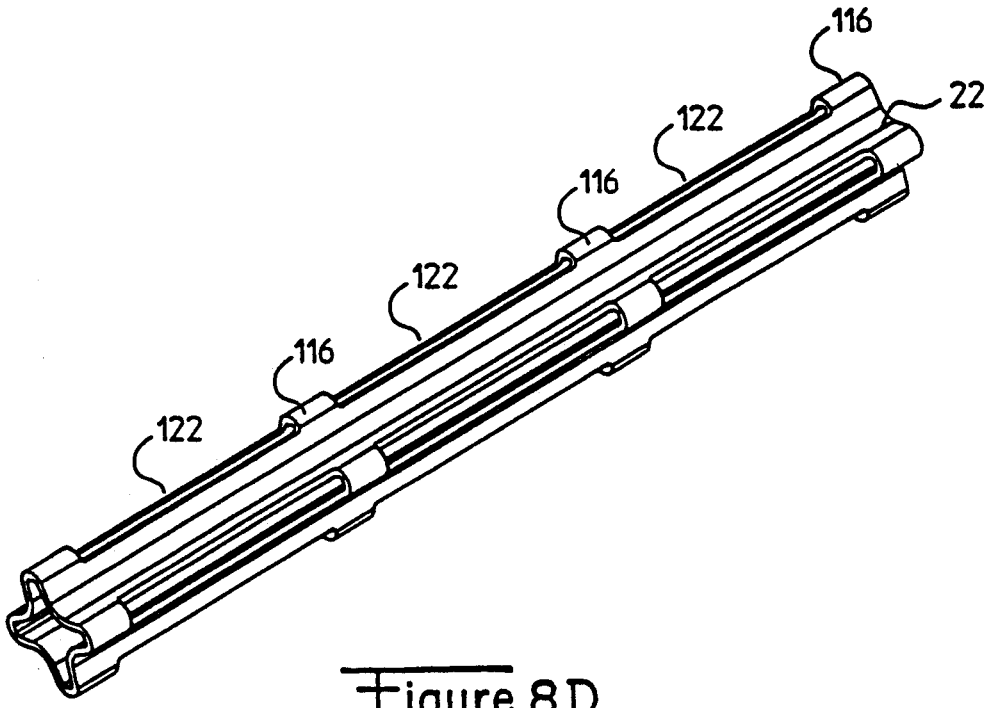
Figure 9A:
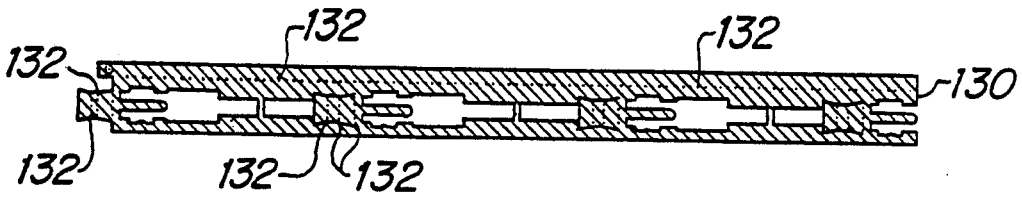
FIGS. 9A and 9B show the mask that shields the bridges from sputtered metal.
Figure 9B:
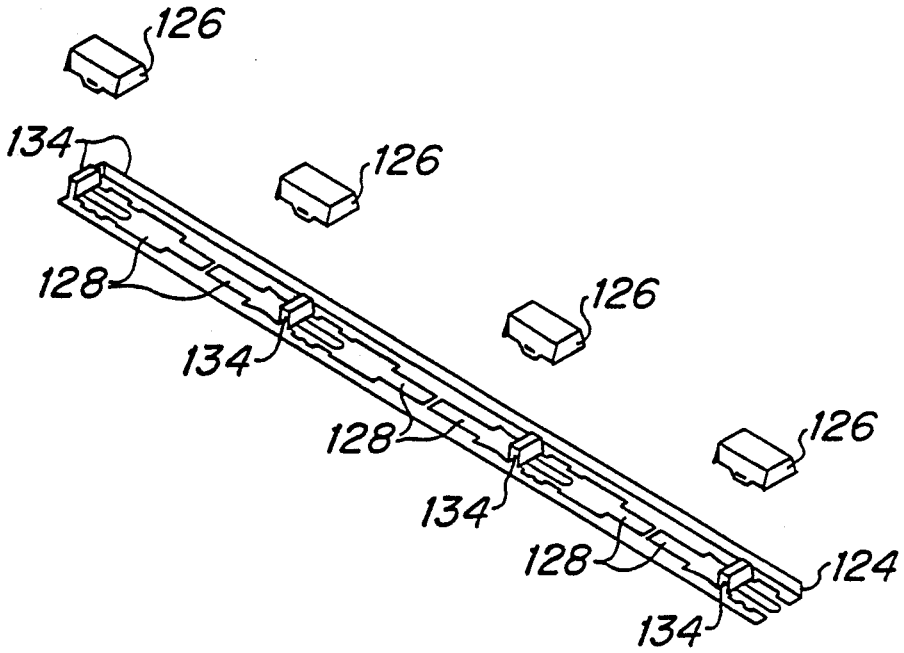

FIG. 9B shows mask 124 that shield bridges 120, shown in FIG. 8D, from being coated with sputtered metal. Mask 124, shown in FIG. 9B, has boxes 126 that completely enclose bridges 120, shown in FIG. 9A. Also, mask 124, shown in FIG. 9B, has holes 128 that line up with aperture 122, shown in FIG. 8D, so that the sputtered metal can reach the inside surfaces of quadrupole substrate. Mask 124, shown in FIG. 9A, is manufactured by stamping a pattern or by chemical milling to form patterned metal strip 130 shown in FIG. 9A. The patterned metal strip 130 is bent along perforations 132 to form the raised sections 134, shown in FIG. 9B and boxes 126 are attached to form the final version of the mask 124.

Most of the sputtered metal adheres to the outer surface of quadrupole substrate 22 shown in FIG. 2 and forms a by-product metallization layer 32 and only a small portion of the sputtered metal adheres to pole substrates 28. To form thin-film layers on pole substrate 28 that have the desired thickness, it is necessary to deposit a thick by-product metallization layer 32. The metals chosen for the thin-film layers must form low stress layers to prevent the fracturing of by-product metallization layer 32. An advantage using a titanium-tungsten composite for the adhesion layer is that it forms a relatively low stress by-product metallization layer 32.

Since gold, the preferred metal for plating substrate 44, does not adhere to the oxide of titanium-tungsten and because titanium-tungsten acts as a getter and absorbs impurities, plating substrate 44 is sputtered onto adhesion layer 40 shortly after formation of this layer. Plating substrate layer 44 seals off the partially assembled quadrupole mass filter so that it can be stored for weeks until the plating steps begin.

Pole 30, shown in FIG. 3, is electroplated or electroless plated onto plating substrate 44 so pole 30 has a resistance of approximately 0.1 Ω from end-to-end that will prevent a substantial voltage drop down the length of pole 30. The thickness of pole 30 will vary between 2.5 to 3.0 μ, depending on the resistivity of the plated gold and the width of the pole. The preferred embodiment places a cylindrical anode into partially constructed quadrupole mass filter 20 that has plating substrate 44. Forming poles 30 through electroplating has the advantage of making poles to precise tolerances. The thickness of pole 30, the uniformity of the thickness of pole 30, and the resistance of pole 30 can be precisely controlled. Forming poles 30 through electroplating or electroless plating has the advantage of taking less time and money and wasting less gold. Also, electroplating has the advantage of forming thicker poles that have a lower resistance.

Gold is the preferred metal for poles because of its low resistivity that reduces the thickness of poles 30. Thin poles 30 have the advantages of greater durability because there is lower stress within the pole layer and because the pole better adheres to the quadrupole substrate. Electroplating other metals onto plating substrates 44 to form poles 30 does not depart from the scope of the invention.

FIG. 4 shows details of the structure enclosed by a rectangle 3 in FIG. 2 for an alternate embodiment of the invention. This embodiment has a separate adhesion layer and a separate diffusion barrier layer. Titanium, chromium, or other metal constitute adhesion layer 40. A diffusion barrier layer 42 sputtered on top of adhesion layer 40 prevents it from diffusing to plating substrate 44 where it would contaminate the oxide-free surface of plating substrate 44. Also, diffusion barrier layer 42 prevents the noble metal of plating substrate 44 from migrating into adhesion layer 40 where it would weaken the bond between the glass and glass substrate. Diffusion barrier layer 42 is formed from platinum, tungsten, or other material. Plating substrate 44 is sputter deposited onto diffusion barrier layer 42 and poles 30 are electroplated in the manner described above.

FIG. 5 shows an alternate embodiment of the invention that does not have an adhesion layer or a diffusion barrier layer. Quadrupole substrate 22 is chemically microetched (using wet or dry chemical etching) to form a microscopic rough surface providing for a mechanical bond. Plating substrate 44 is sputtered deposited directly on the microetched quadrupole surface and poles 30 are electroplated in the manner described above.

Figure 6A:
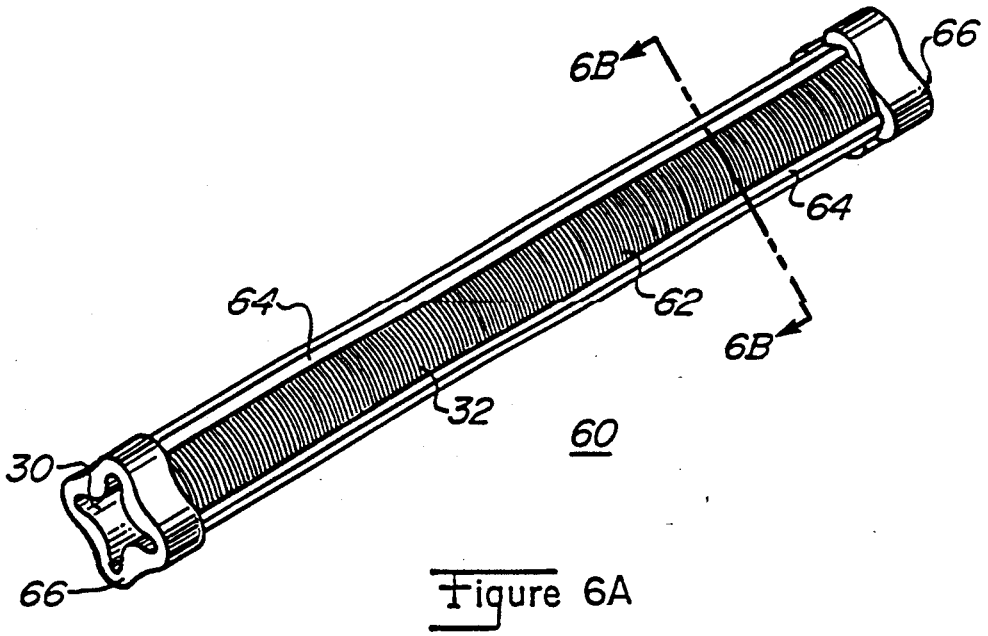
FIG. 6A shows an isometric view of an alternate embodiment of the multilayer quadrupole mass filter that has elongated apertures.
Figure 6B:
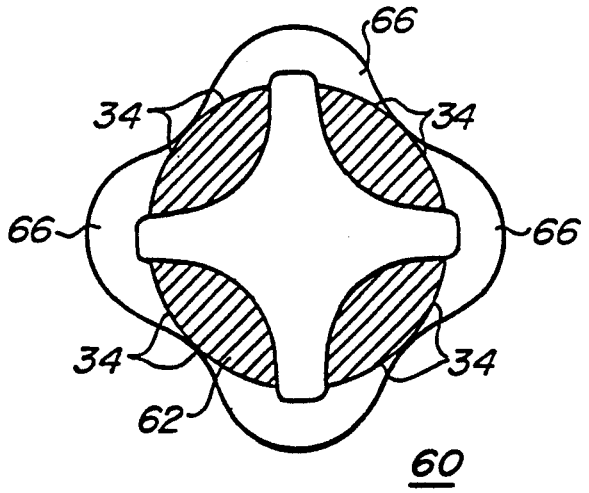
FIG. 6B shows a cross-section of the alternate embodiment of the multilayer quadrupole mass filter taken along the line 6B—6B in FIG. 6A.

FIGS. 6A and 6B show multilayer quadrupole mass filter 60 with elongated apertures. FIG. 6A shows an isometric view and FIG. 6B shows a cross-section view. Quadrupole mass filter 60 has a quadrupole substrate 62 with eight end-positioned bridges 66 and four long apertures 64 that extend most of the way across it. Quadrupole substrate 62 must be thicker than quadrupole substrate 22, shown in FIG. 1, because it has fewer bridges and relies on its thickness of 3 to 5 mm for structural rigidity. Quadrupole substrate with elongated apertures 62 is manufactured in the same manner as quadrupole substrate 22, shown in FIG. 1.

This embodiment has the advantage of reducing the length of pole/bridge interface 34 to the length of the end-positioned bridges 66 so that the amount of unwanted charge is reduced. Also, this embodiment has the advantage of restricting the accumulation of unwanted charge to the ends of quadrupole substrate 62 where it can be controlled by a voltage-gradient reducing compound such as a potassium silicate compound.

Figure 7A:
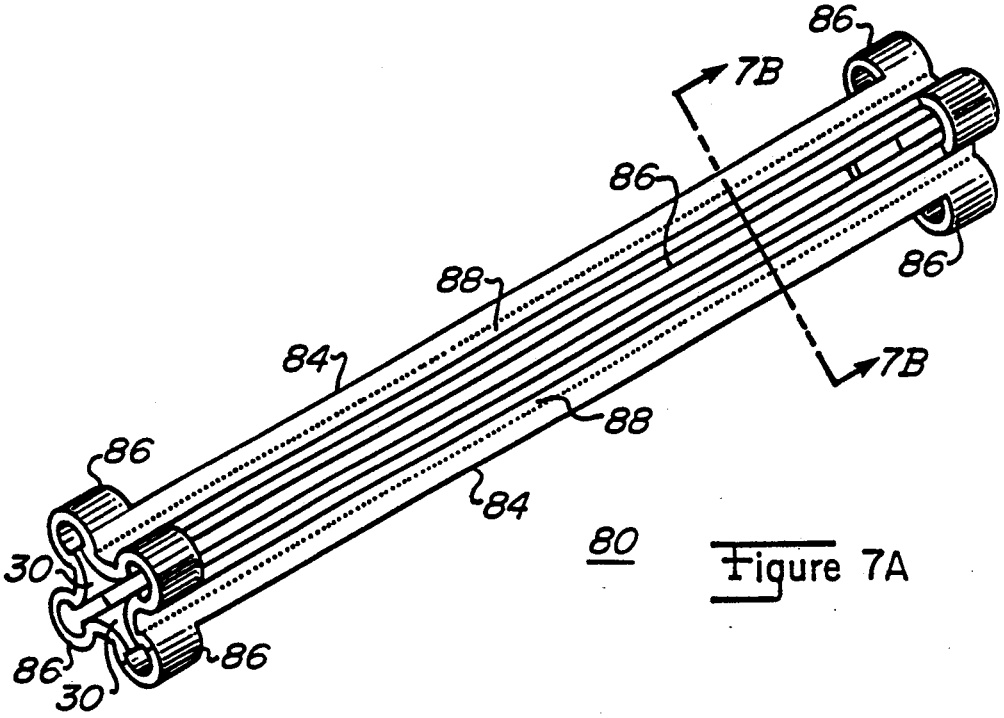
FIG. 7A shows an isometric view of an alternate embodiment of the multilayer quadrupole mass filter with extended bridges.
Figure 7B:
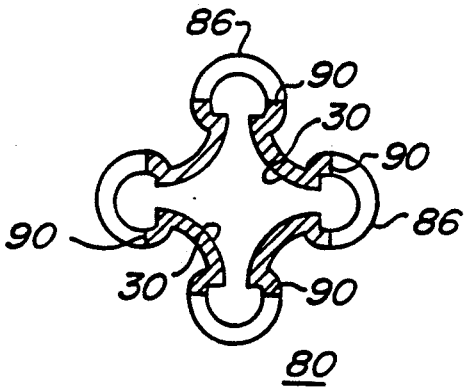
FIG. 7B shows a cross-section of the alternate embodiment of the multilayer quadrupole taken along the line 7B—7B shown in FIG. 7A.

FIG. 7A shows an isometric view and FIG. 7B shows a cross-section of an alternate embodiment of the quadrupole mass filter 80 that has extended bridges 86. Extended bridges 86 increase the distance between the pole/bridge interface 90, shown in FIG. 7B, and the center axis of the quadrupole mass filter where the most of the charge particle separation takes place. Increasing this distance has the effect of the decreasing the distorting effect of the accumulated electrical charge on the mass selection field since the amplitude of the distortion field created by pole/bridge interface 90 decreases with approximately the square of the distance from the pole/bridge interface 90. Another advantage of the embodiment shown in FIG. 7A is the absence of a line of sight between the pole/bridge interface 90 and the center axis of the quadrupole mass filter 80.

Figure 7C:
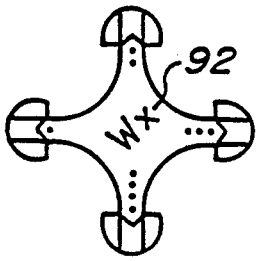
FIG. 7C shows the mandrel used to make the quadrupole substrate with extended bridges shown in FIGS. 7A and 7B.

FIG. 7C shows a cross-section of a mandrel 92 used for forming a quadrupole substrate with extended bridges 82. Mandrel 92 is made the out of the same materials and in the same way as mandrel 110 shown in FIG. 8A. Quadrupole substrate with extended bridges 82 can be made in the same way as the quadrupole substrate 22 of the preferred embodiment shown in FIG. 1. A glass tube 112 that fits over mandrel 92 must drop a significant distance before it seals-off mandrel 92 and the deepest portion of mandrel 92 is the most important part of mandrel 92: the hyperbolic pole substrate 88. An alternative method is a two-step process that drops the glass tube twice, first on a mandrel with loose tolerances and next on mandrel 92 that is slightly smaller and that is made to precise specifications.

When extended bridges 86 are removed to form long apertures 84, u-channels form that give the extended bridge quadrupole substrate 80 robust mechanical support. Glass tube 110, shown in FIG. 8A, can have the thickness of the glass used to make quadrupole substrate 22, shown in FIG. 1.

Any of the quadrupole substrates disclosed herein may be coated with any of the multilayer structures or variations of the multilayer structures without departing from the scope of the invention. Variations of the multilayer structure that are within the scope of the invention include the use of substitute metals for the various layers and the use of an adhesion layer without use of a diffusion barrier layer.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen to best explain the best mode of the invention. Thus, it is intended that the scope of the invention to be defined by the claims appended hereto.

What is claimed is:

1. A multipole, comprising:

a. a multipole substrate having an even number of pole substrates, each having an inner surface that has a generally hyperbolic cross section, the pole substrates being arranged in parallel opposing pairs, and bridges connecting adjacent pairs of pole substrates;

b. plating substrates that conform to the inner surfaces of the pole substrates; and c. electroplated poles conforming to the plating substrates so that the electroplated poles have a generally hyperbolic cross-section.

2. An apparatus, as in claim 1, wherein the plating substrates are a thin-film noble metal layer.

3. An apparatus, as in claim 1, further comprising a thin-film adhesion layer located between the multipole substrate and the plating substrates.

4. An apparatus, as in claim 3, wherein the thin-film adhesion layer is titanium.

5. An apparatus, as in claim 4, wherein the plating substrates are a thin-film noble metal layer.

6. An apparatus, as in claim 5, further comprising a means for preventing diffusion of the thin-film adhesion layer and the plating substrates.

7. An apparatus, as in claim 1, further comprising a thin-film adhesion/diffusion barrier layer.

8. An apparatus, as in claim 7, wherein the thin-film adhesion/diffusion barrier layer is a thin-film platinum or tungsten layer.

9. An apparatus, as in claim 8, wherein the plating substrates are a thin-film noble metal layer.

10. An apparatus, as in claim 1, further comprising an aperture located in between each of adjacent bridge pair.

11. An apparatus, as in claim 1, further comprising a means for increasing a distance between a pole/bridge interface and a center axis of the multipole.

12. An apparatus, as in claim 1, wherein the electroplated pole has an electroplated layer not less than 2.5 microns thick.

13. A multipole, comprising:

a. a multipole substrate having an even number of pole substrates with inner surfaces having a generally hyperbolic cross section, the pole substrates being arranged in parallel opposing pairs, and bridges connecting adjacent pairs of pole substrates;

b. an aperture located in between each of adjacent bridge pair; and c. electroplated poles conforming to the inner surfaces of the pole substrates.

14. A multipole, as in claim 13, wherein the width of the aperture equals the width of the bridge.

15. A multipole, as in claim 13, further comprising a means for increasing a distance between a pole/bridge interface and a center axis of the quadrupole.

16. An apparatus, as in claim 13, wherein the electroplated poles are electroplated with a layer not less than 2.5 microns thick.

17. A quadrupole, comprising:

a. a quadrupole substrate having four pole substrates, each having an inner surface that has a generally hyperbolic cross section, the pole substrates being arranged in parallel opposing pairs, and bridges connecting adjacent pairs of pole substrates;

b. plating substrates that conform to the inner surfaces of the pole substrates; and c. electroplated poles conforming to the plating substrates so that the electroplated poles have a generally hyperbolic cross-section.

18. An apparatus, as in claim 17, further comprising a thin-film adhesion layer located between the pole substrates and the plating substrates.

19. An apparatus, as in claim 18, wherein the plating substrates are a thin-film noble metal layer.

20. An apparatus, as in claim 19, further comprising an aperture located in between each of adjacent bridge pair.

21. An apparatus, as in claim 20, further comprising a means for increasing a distance between a pole/bridge interface and a center axis of the quadrupole.

22. An apparatus, as in claim 17, further comprising a thin-film adhesion/diffusion barrier layer.

23. An apparatus, as in claim 22, wherein the plating substrates are a thin-film noble metal layer.

24. An apparatus, as in claim 23, further comprising an aperture located in between each of adjacent the bridges pair.

25. An apparatus, as in claim 24, further comprising a means for increasing a distance between a pole/bridge interface and a center axis of the quadrupole.

* * * * *